US005673449A

United States Patent [19]

Henriksson et al.

[11] Patent Number: 5,673,449

[45] Date of Patent: Oct. 7, 1997

[54] FLOW COMPENSATION DEVICE FOR BRIDGE PILLARS

[75] Inventors: Mats Henriksson; Nils Johansson, both of Älvkarleby, Sweden

[73] Assignee: Vattenfall Utveckling AB, Alvkarleby, Sweden

[21] Appl. No.: 553,439

[22] PCT Filed: May 25, 1994

[86] PCT No.: PCT/SE94/00488

§ 371 Date: Nov. 21, 1995

§ 102(e) Date: Nov. 21, 1995

[87] PCT Pub. No.: WO94/28249

PCT Pub. Date: Dec. 8, 1994

[30] Foreign Application Priority Data

May 26, 1993 [SE] Sweden ..... 9301789

[51] Int. Cl.[6] ..... E02B 3/02

[52] U.S. Cl. ..... 14/75; 405/80; 405/81

[58] Field of Search ..... 14/75, 76; 405/52, 405/80, 84, 81; 137/236.1

[56] References Cited

U.S. PATENT DOCUMENTS

| | | | |
|---|---|---|---|
| 2,545,104 | 3/1951 | Musial . | |
| 3,667,234 | 6/1972 | De Lizasoain | 405/80 |
| 5,478,167 | 12/1995 | Oppenheimer et al. | 405/80 X |

FOREIGN PATENT DOCUMENTS

| | | |
|---|---|---|
| A10450543 | 10/1991 | European Pat. Off. . |
| 397599 | 8/1933 | United Kingdom . |

*Primary Examiner*—James Lisehora
*Attorney, Agent, or Firm*—Young & Thompson

[57] ABSTRACT

There is disclosed a bridge or like pillar (1) erected in a moving body of water in which the water may periodically flow in strata in one as well as the other of two opposite main flow directions. The pillar is provided with a flow compensation device including a motor-driven stream generator (9) which functions to set part of the water in motion thus compensating for the flow resistance exerted by the pillar in the water body.

12 Claims, 2 Drawing Sheets

FLOW COMPENSATION DEVICE FOR BRIDGE PILLARS

TECHNICAL FIELD OF THE INVENTION

The present invention relates to a flow compensation device for support pillars. More particularly, there is provided a flow compensation device used in conjunction with a support pillar, such as a bridge pillar, and which is normally erected in a flowing body of water such as a sound river or the like. Such water may at least periodically flow in different layers or strata in one as well as the other of two opposed stream directions.

BACKGROUND OF THE INVENTION

As a specific example of a flowing body of a water current in a river or ocean of the above-mentioned type, the Sound of Öresund may be mentioned. Öresund is a water body/sound between Sweden and Denmark which joins the Baltic Sea with a part of the Atlantic Ocean (the North Sea). The Baltic Sea, of itself, is an inland or brackish water sea in which the salt content in the North Sea is substantially higher (in the central parts thereof it lies in the range of 2,5–3,5%). The water motion through the sound mainly occurs by a stratified current or tide in which the brackish water from the Baltic Sea moves in a surface layer towards the North Sea at the same time as salt water from the North Sea moves in a bottom layer towards the Baltic Sea. The depths of these two layers vary during different times depending on a number of different factors, such as wind conditions atmospheric pressure conditions, time of the year, etc.

If great quantities of brackish water flow out of the Baltic Sea at the same time as only small volumes of salt water flow into it, the surface water layer will, of course, be deep and the bottom water layer will be shallow, and vice versa. The total water depth is on average within the range of 5–8 meters over a large portion of the Öresund sound, with the interface between the surface and bottom water layers then normally lying about 1.5–4 meters from the bottom.

For the plant life and animal life of e.g. the Baltic Sea area, it is of vital importance that the relatively small salt content, which typically occurs in a brackish sea water, be maintained at a certain minimum level or otherwise biological imbalances could result with fatal effects. For example, a fish such as cod is highly dependent on a certain minimum salinity for its reproduction. The inflow of fresh water into the Baltic Sea, occurring via rivers and creeks in adjoining countries, is greater than the evaporation volume of surface water from the surface, but has on the whole, always been compensated for by the fact that salt water from the North Sea at high water-levels and/or precipitous wind conditions from time to time pass through the Öresund sound and mix with the water in the Baltic Sea. Thus a minimum salinity occurs, which on average, is acceptable.

It is a general concern that pillars used in construction projects in flowing water conditions, and which are required for e.g. supporting arched portions of a bridge, may have an effect on the influx of salt water through the Sound, which is vital for the Baltic Sea. Provisional estimations indicate that bridge pillars could reduce the salt water inflow no less than 2 to 5%, at least during periods when the salt water inflow is great, i.e. the interface between the surface and bottom water layers lies near the surface or is completely disappeared in case just a throughout salt water flow occurs.

In order to cope with this problem, it has been proposed to dredge the sea floor in the area of any pillars for projected bridges so as to increase the water depth and thereby compensate for the flow restriction exerted by the pillars. Such a solution has, however, a number of disadvantages. Thus the bottom fauna of the body of water would be subjected to damage and could even be completely eliminated in certain areas. At the same time, dredging is an expensive operation which does not provide any permanent solution since the sea floor will subsequently be filled with sediments.

One system involving ice related conditions in flowing water is set forth in U.S. Pat. No. 2,845,104. This reference discloses a motor-driven ice removal device relative to a bridge pillar; this device is thus not a water flow or stream generator. The ice device has a vertical cylinder with a bottom end positioned down into a surface layer of water surrounding the pillar. The function of the cylinder is to remove ice from the upstream side of the pillar, and for thus is provided with pairs of opposed arms which, at their free ends, include claws for gripping flowing ice and setting it in motion in a downstream direction.

Generally speaking, if, in an arrangement such as that discussed above, a pair of diametrically opposed arms are operating in the water at all, the arrangement will result in a cancellation effect, since the forward driving effect of one arm will be counteracted by the backward driving effect of the other arm. Therefore, the device operates like a whisk which whisks around water in the vicinity of the cylinder, but does not provide any positive downstream or upstream stream generation.

SUMMARY OF THE INVENTION

The present invention aims at setting aside or reducing—by simple means—environmental disadvantages associated with the erection of bridge pillars in water courses of the art mentioned. Accordingly, a fundamental object of the invention is to provide an improved device which, without detriment to the environment, is capable of compensating for a water flow reduction caused by bridge pillars.

A further object of the present invention is to provide a flow compensation device for pillars of the type which are erected in connection with flowing water and which are surrounded by water that periodically flows layerwise or in strata in opposed main stream directions, characterized in that the pillar includes stream or flow generator means for imparting motion in at least one of the main stream directions so as to compensate for the flow resistance created or exerted by the pillar.

A further object is to provide such a device capable of fulfilling this task at a moderate cost.

Another object is to provide a device which can be put into operation only when needed so as no efficiently contribute to a salt water influx only when there is a large natural flow of such water, bun at the same time permitting the device to be inactive when the natural salt water flow is low or non-existent.

A further object of the invention is to provide an appropriate device which is easy to install and maintain.

BRIEF DESCRIPTION OF THE DRAWINGS

Having thus generally described the invention, reference will now be made to the accompanying drawings illustrating preferred embodiments, and in which.

DETAILED DESCRIPTION OF PREFERRED EMBODIMENTS OF THE INVENTION

Figure 1:
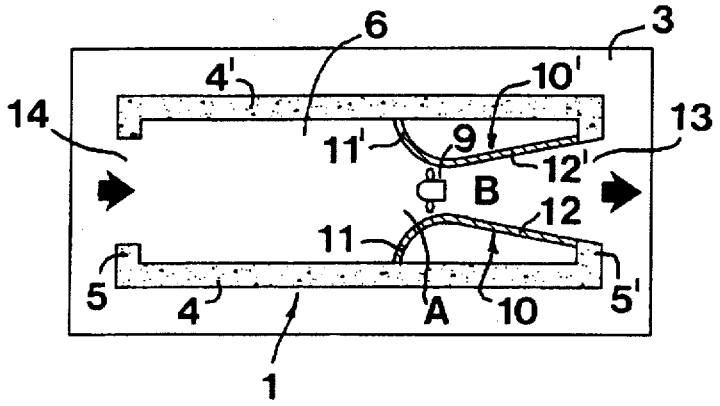
FIG. 1 is a horizontal cross-section through a bridge pillar with a device according to one embodiment of the invention.

In the drawings, 1 generally designates a typical vertically standing pillar with the bottom end resting against a substrate e.g. the sea floor 2 via a bottom plate 3. The upper end (not shown) of the pillar may e.g. support a bridge arch.

Figure 2:
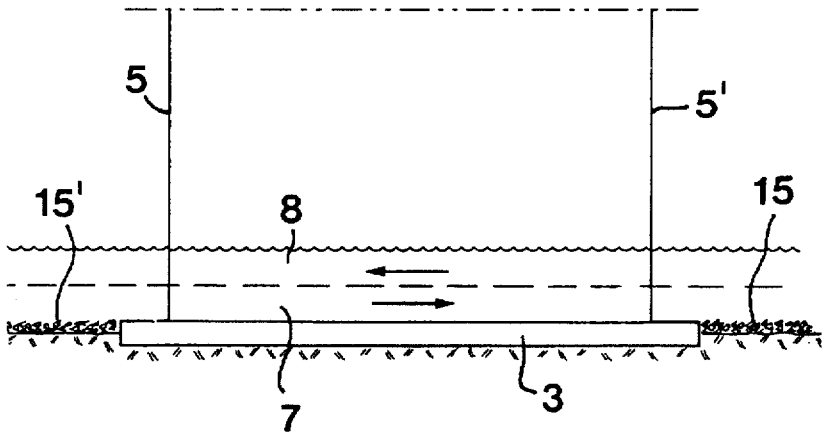
FIG. 2 is a aide view of the bottom portion of the bridge pillar according to FIG. 1.

As seen in FIG. 1, the bridge pillar 1 of this example is hollow and comprises two mutually spaced-apart long side walls 4, 4' and two gable or end walls 5, 5'. These walls together define an internal pillar cavity or chamber designated 6. The dimensions of the pillar may vary depending on its function, e.g. depending the size of a bridge. As an example, a bridge of the type intended to be built over the Öresund may, in practice, include pillars with side walls 4, 4' which may have a length of 40 m to 60 m, typically about 50 m, and with gable walls 5,5' of a length of 15 m to 25 m, typically about 20 m. The thickness of the walls is in the range of 1.5 m to 3.0 m, typically 2.0 m to 2.5 m. In the finished bridge, the individual pillar extends with its greatest cross-sectional dimension transversely of the longitudinal direction of the bridge, i.e., the longside walls 4, 4' will extend substantially at right angles to the span. Periodically the water surrounding the bridge pillar flows in a layered flow as shown in FIG. 2, particularly in a bottom layer 7 consisting of salt water and a surface layer 8 of brackish water. In FIG. 2 The bottom layer 7 is shown to flow in a direction from the left to the right, while the surface or top layer 8 flows in the opposite direction. Thus the gable wall 5 forms an upstream end in respect of the salt wafer layer 7 and the gable wall 5' forms an downstream end.

Figure 3:
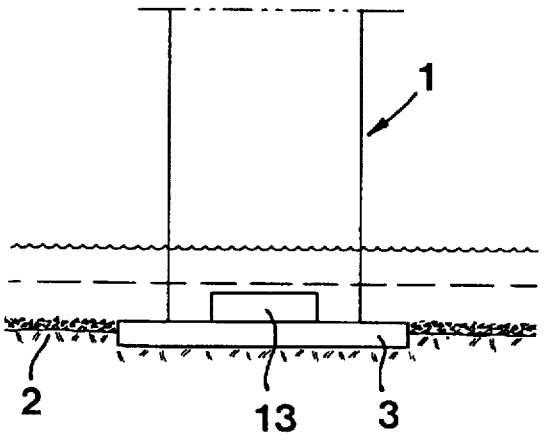
FIG. 3 is an end view of the same pillar portion (viewed at a 90° angle relative to the view of FIG. 2)

Within the bridge pillar of FIG. 1, a stream or flow generator 9 is mounted which, in this case, comprises a propeller unit, e.g. a bow propeller. This propeller unit is mounted in the area between a pair of water-guiding walls 10, 10', each one of which has a frontal curved portion 11, 11' and which in turn passes into a straight wall portion 12, 12'. As illustrated in FIG. 1 the straight wall portions 12, 12' diverge towards the downstream gable wall 5' where they terminate in an outlet opening 13 (see also FIG. 3). Water for the stream generator 9 is drawn through an inlet opening 14 in the upstream gable wall 5. The curved wall portions 11, 11' define a space functioning as an ejector chamber A, while the following diverging wall portions 12, 12' define a space functioning as a diffuser B. When the propeller unit 9 is in operation, it will impart motion to the water passing from the inlet 14 towards the outlet 13. The water in the area of the ejector chamber A achieves a relatively high flow speed, which successively decreases in velocity as the water subsequently passes through the diffuser chamber B. While the final speed of the water, however, is higher than the flow speed of the water stream surrounding the pillar in the bottom strata or layer 7, it is nevertheless low enough so that the sea floor behind will not be damaged; the flow speed is also low enough so that the interface existing between the salt water and brackish water streams will not be destroyed. In this connection, it should be pelted out that the inlet 14, as well as the outlet 13, are positioned at a relatively low level of the bridge pillar; both may be at the same level. As seen from FIG. 3 the outlet 13 (and also the inlet) is placed in the transition area between the bottom end of the pillar 1 and the bottom plate 3, preferably in such a manner that the lower line of the outlet approximately aligns with the upper side of the bottom plate. It should also be pointed out that the cross-sections of the inlet 14 and the outlet 13 are substantially equal in size. In practice the two openings should have a height in the range of 1 to 3 m, typically 1.5 to 2.5 m and a width amounting to at least half the width of the gable walls 5 and 5', respectively.

In accordance with a preferred embodiment of the invention, a special protective layer 15 is arranged on the sea floor in the area downstream of the outlet 13, and preferably also in the area upstream of the inlet 14 (layer 15') in order to protect the sea floor against erosion. In practice, these erosion protecting layers may be gravel layers of a suitable depth.

Figure 4:
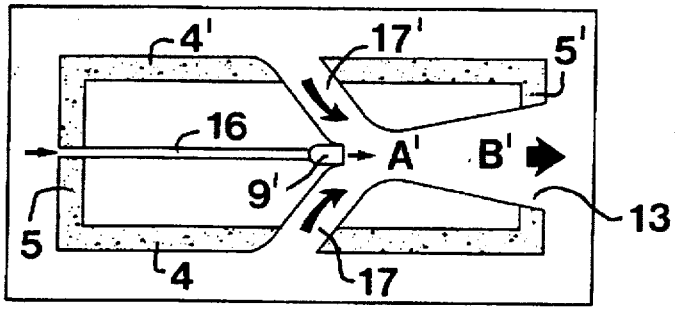
FIG. 4 is a horizontal section similar to FIG. 1, showing an alternative embodiment of the invention.

In FIG. 4, an alternative embodiment of the invention is illustrated in which the stream or flow generator 9' consists of a water jet assembly of the type including a pump, an inlet conduit 16 to the pump and an ejector nozzle from which water exiting from the pump is accelerated at a high speed. In the example shown, two inlets or intakes 17,17' are recessed in the side walls 4,4' of the pillar with the inlets meeting in a common ejector chamber A'. Water from chamber A' is led to a diffuser chamber B' by means of water-guiding walls which are basically of the same type as in FIG. 1. The water emitted by the jet assembly 9' carries away the water passing in through the inlets 17,17', and sets it in motion. The speed of the water which is relatively high in the ejector chamber A', but the speed progressively decreases so as to become moderate at the outlet 13. Nonetheless, it is noticeably higher than the average flow speed in the salt water bottom stream 7. Although the water coming into the ejector chamber A' comes in through openings in the side walls 4,4', (in the example of FIG. 4), it may also be taken in through one single inlet opening placed, for instance, in the upstream gable wall 5.

The propeller unit 9 according co FIG. 1 as well as the pump included in the jet assembly 9' of FIG. 4 are both motor-driven, preferably by means of electric power (not shown). By means of electric power, the motors can be supplied with the necessary energy in a simple way, also in respect of installation and maintenance is simple inasmuch as electric cables can easily be placed along a bridge span and separate branch conduits can readily go down each individual pillar. The dimensions of the motor are made on a decisive flow speed basis, the size and shape of the pillars, degree of compensation for the braking effect of the pillar, etc. As an example, the approximate power requirement for a rectangular pillar of a size 20×50 m, a water flow speed of 1 m/sac., a water depth of 7 m and a centre distance of 200 m between adjacent pillars has been calculated. At a 50% efficiency in the stream generator, the ejector chamber and the diffusor, a power requirement of 250 Kw (kilowatts) would be required.

The devices according to FIGS. 1 and 4, respectively operate in the following manner. When the flow of the brackish water past the bridge is great, and the salt water flow is smaller, the interface between the two flow layers 7,8 is situated deeply below the water surface. Pillar 1 by its width (e.g. 20 m) will exert a flow resistance. However, this flow resistance does not have any effect on the salt water influx, and thus in this case is indeed insignificant. In this condition the stream generators 9,9' would therefore be inactive. When the salt water flow in the bottom layer 7 increases considerably, at the sacrifice of the brackish water flow in the surface layer 8, the stream generators will go into operation. An increase of the salt water flow in the bottom layer 7 may occur under different circumstances, but most common is that the water-level in the salt water increases at the same time as wind forces the salt water throughout the sound past the bridge. The flow resistance exerted by the pillars of the bridge is compensated for by means of each stream generator which sets the water surrounding the pillar in motion with an increased speed. The propelling force exerted by the stream generator on the water may, by a suitable selection of the motors in question, be selected in such a way that the flow resistance is more or less compensated for, but it is also conceivable to provide an over-compensation by bringing the stream generator to establish a water flow which is greater than the water flow which is lapsed by the presence of the pillars in the water. Theoretically, a lower compensation is conceivable.

By utilizing the stream or flow generators during the comparatively short periods when the salt water influx is naturally high, the running-time and the running expenses for the stream generator will be low, calculated on an annual basis. Other advantages of the device according to the invention is that the same is easy to set up and that it makes it possible to secure an unchanged salt water influx in spite of the erection of the support pillars in question without calling for any environmentally unfavourable measures in the form of dredgings or the like.

Figure 5:
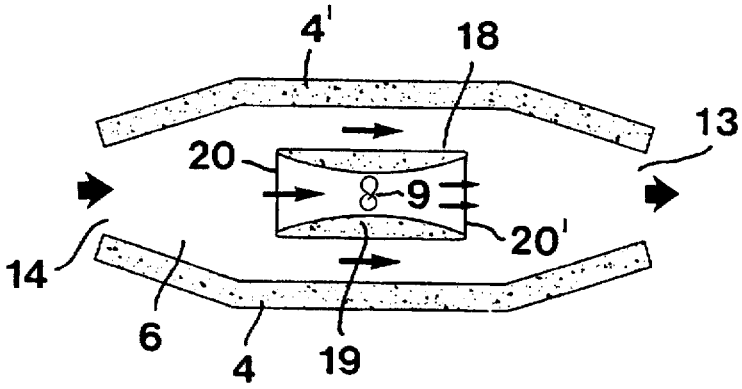
FIG. 5 is a horizontal section showing a further alternative embodiment.

FIG. 5 illustrates an alternative embodiment in which the gable end portions of the pillar have a wedge-like or tapering shape in order to reduce the flow resistance of the pillars itselves. In this case a propeller 9 serving as a stream generator is placed within a tube or tubular body 18 which in turn is mounted within the cavity 6 of the pillar at a suitable level above the bottom plate in question, e.g. by means of legs (not shown) beneath the tube. The diameter of the tube body 18 is smaller than the width of the cavity so as to allow water to flow around the same. The external surface of the tube body may be substantially cylindrical, while the wall thickness thereof successively decreases from a central portion 19 towards each one of the end openings 20,20'. The propeller is situated in the internal passage through the tube and is reversible as to make it possible to transport water therethrough in either one of two opposite directions. In other words water may either be set in motion as indicated by the arrows in FIG. 5 with the pillar opening 14 serving as an intake and opening 13 serving as an outlet, or in the opposite direction with opening 13 serving as an intake and opening 14 serving as an outlet. When water is sucked into the internal passage of the tube body by means of the propeller, e.g. from the left to the right as in FIG. 5, the end portion of the passage situated downstreams the propeller and in the vicinity of the opening 20' will serve as a diffuser When the water leaves the tube body it will entrain the surrounding water between the outside of the tube body and the inside of the pillar walls so as to establish a water flow of increased flow rate out of the outlet 13. In practice the internal passage should have a substantially circular cross-sectional shape in the vicinity of the propeller, while the cross-sectional shape of the diffuser portions near the end openings 20,20' may be circular or polygonal, e.g. rectangular.

Figure 6:
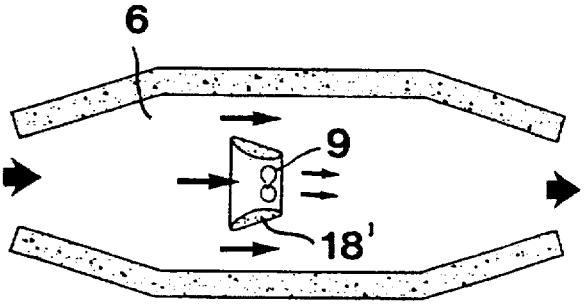
FIG. 6 is a similar section showing a still further alternative embodiment.

In FIG. 6, a propeller 9 is mounted within a tube or tubular body 18' having a substantially frustoconical or like tapering shape. The propeller is placed within the tube at its narrow rear or downstream end. The tube may be fixedly arranged within the cavity 6 of the pillar, so that a waterflow through the pillar may be established in one direction only (from the left to the right in FIG. 6). It may, however, also be rotatable at least 180° in case of which the flow may be reversed.

The invention is not limited merely to the embodiments described above and shown in the drawings. Thus it is possible to mount the stream generator in other ways within a pillar, though the embodiments illustrated are preferred in practice. It should also be pointed out that the geometric shape of the pillar may be modified in order to further reduce the flow or stream resistance.

We claim:

1. A flow compensation device for a support pillar of the type adapted to be mounted in a moving body of water, characterized in that said pillar (1) includes stream generator means (9,9') for imparting motion to the water so as to at least partially compensate for the flow resistance exerted by the pillar on the moving body of water.

2. A device according to claim 1, characterized in that said stream generator means (9,9') is placed within a bridge pillar having at least one water inlet (14) and at least one water outlet (13), said stream generator means being connected to said inlet for receiving a flow of water and being connected to said outlet for permitting discharge of water.

3. A device according to claim 2, characterized in that said inlet (14) and outlet (13) are located an the lower end of said pillar (1) with the lower end of said pillar being adapted to be located in the vicinity of the sea floor.

4. A device according to claim 3, characterized in that the stream generator means is a water jet assembly (9').

5. A device according to claim 3, characterized in that an erosion protecting layer is arranged on the sea floor adjacent said outlet.

6. A device according to claim 2, characterized in that the stream generator means is arranged in connection with an ejector chamber (A) downstream from which a diffusor (B) is arranged in connection with the outlet (13).

7. A device according to claim 6, characterized in that an erosion protecting layer is arranged on the sea floor adjacent said outlet.

8. A device according to claim 1, characterized in that an erosion protecting layer is arranged on the sea floor adjacent said outlet.

9. A device according to claim 1, characterized in that the stream generator means is a water jet assembly (9').

10. A device according to claim 1, characterized in that the stream generator means is a propeller (9).

11. A device according to claim 10, characterized in that an erosion protecting layer is arranged on the sea floor adjacent said outlet.

12. A device according to claim 1 characterized in that the stream generator means is a water jet assembly (9').

* * * * *